US005407775A

United States Patent [19]

Larson et al.

[11] Patent Number: 5,407,775

[45] Date of Patent: Apr. 18, 1995

[54] LIQUID DEVELOPER COMPOSITIONS WITH BLOCK COPOLYMERS

[75] Inventors: James R. Larson, Fairport; John W. Spiewak, Webster, both of N.Y.

[73] Assignee: Xerox Corporation, Stamford, Conn.

[21] Appl. No.: 185,341

[22] Filed: Jan. 24, 1994

[51] Int. Cl.[6] ..... G03G 9/135

[52] U.S. Cl. ..... 430/115; 430/49

[58] Field of Search ..... 430/115

[56] References Cited

U.S. PATENT DOCUMENTS

| | | | |
|---|---|---|---|
| 4,707,429 | 11/1987 | Trout | 430/115 |
| 4,760,009 | 7/1988 | Larson | 430/137 |
| 5,019,477 | 5/1991 | Felder | 430/115 |
| 5,026,621 | 6/1991 | Tsubuko et al. | 430/109 |
| 5,030,535 | 7/1991 | Drappel et al. | 430/116 |
| 5,035,972 | 7/1991 | El-Sayed et al. | 430/114 |
| 5,069,995 | 12/1991 | Swidler | 430/115 |
| 5,106,717 | 4/1992 | Houle et al. | 430/115 X |
| 5,130,221 | 7/1992 | El-Sayed et al. | 430/115 X |
| 5,290,653 | 3/1994 | Pearlstine | 430/115 X |

*Primary Examiner*—Roland Martin
*Attorney, Agent, or Firm*—E. O. Palazzo

[57] ABSTRACT

A liquid developer comprised of a liquid, thermoplastic resin particles, a nonpolar liquid soluble charge director comprised of a zwitterionic quaternary ammonium block copolymer wherein both cationic and anionic sites contained therein are covalently bonded within the same polar repeat unit in the quaternary ammonium block copolymer.

25 Claims, No Drawings

LIQUID DEVELOPER COMPOSITIONS WITH BLOCK COPOLYMERS

BACKGROUND OF THE INVENTION

This invention is generally directed to liquid developer compositions and, in particular, to liquid developers containing zwitterionic quaternary ammonium block copolymers wherein both cationic and anionic sites are covalently bonded within the same polar repeat unit in the polar A block of the AB diblock copolymer. The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after extensive research efforts, and which toners result in, for example, sufficient particle charge for transfer and maintain the mobility within the desired range of the particular imaging system employed. Advantages associated with the present invention include increasing the desired negative charge on the developer particles and in embodiments providing a charge director that is superior to similar charge directors like tetraalkyl quaternary ammonium block copolymers, lecithin, and metal salts of petroleum fractions. Some of the aforementioned additives like lecithin contain impurities which can have an adverse effect on their intended function. The superior charge can result in improved image development and superior image transfer.

A latent electrostatic image can be developed with toner particles dispersed in an insulating nonpolar liquid. The aforementioned dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Useful liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns (pro) average by area size as measured as determined by the Horiba Capa 500 or 700 particle sizers.

Since the formation of images depends, for example, on the difference of the charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors may include both negative charge directors, such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) selected from the group consisting of butadiene and acrylate.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles, may be selected from known thermoplastics, including fluoropolymers.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner so that the toner is provided with both liquid repelling and solvent soluble properties.

Moreover, in U.S. Pat. No. 4,707,429 there are illustrated, for example, liquid developers with an aluminum stearate charge additive. Liquid developers with charge directors are also illustrated in U.S. Pat. No. 5,045,425.

Further, stain elimination in consecutive colored liquid toners is illustrated in U.S. Pat. No. 5,069,995. Additionally, of interest are U.S. Pat. Nos. 4,760,009 and 5,034,299.

The disclosures of each of the U.S. patents mentioned herein are totally incorporated herein by reference.

In copending patent application U.S. Ser. No. 986,316 (D/91310), the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., which developer has a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In copending patent applications and patents U.S. Ser. No. 065,414 U.S. Pat. Nos. 5,306,591, 5,308,731, 5,300,393 and U.S. Ser. No. 929,227 (D/92092), the disclosures of which are totally incorporated herein by reference, there is illustrated a liquid developer comprised of a certain nonpolar liquid, thermoplastic resin particles, a nonpolar liquid soluble ionic or zwitterionic charge director, and a charge adjuvant comprised of an aluminum hydroxycarboxylic acid, or mixtures thereof.

U.S. Pat. No. 5,300,393 discloses a process for the preparation of photoconductive imaging members which comprises coating a supporting substrate with a photogenerator layer comprised of photogenerating pigments and a mixture of cyclic oligomers wherein said mixture is heated to obtain a polycarbonate resin binder, and subsequently applying to the photogenerating layer a layer of charge transport molecules; U.S. Pat. No. 5,306,591 discloses a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

SUMMARY OF THE INVENTION

It is an object of the present invention is to provide liquid developers with many of the advantages illustrated herein.

Another object of the present invention is to provide liquid developers capable of high particle charging and fast toner charging rates.

Another object of the invention is to provide a negatively charged liquid developer wherein there is selected as charge directors zwitterionic quaternary ammonium AB diblock copolymers wherein both cationic and anionic sites are covalently bonded within the same polar repeat unit in the polar A block of the block copolymer. As a result of the covalent attachment of both the anionic and cationic sites to the polar A block of the AB diblock copolymer charge director, there are no polymer unbound ions that are free to migrate and generate undesirable high conductivities in developers charged with the zwitterionic quaternary ammonium AB diblock copolymer charge directors. Examples of acceptable conductivity and mobility ranges for developers charged with the zwitterionic charge directors of this invention are illustrated herein. Conductivities measured at ambient temperature (21° to 23° C.) for developers containing one percent toner solids are considered high in the 10 to 20 pmhos/cm range and very high at greater than 20 pmhos/cm. Optimum conductivities are less than about 10 pmhos/cm. As conductivities increase above the optimum range, excess ions can compete with toner particles of the same charge for development of the latent image giving rise to low developed mass resulting in low print density images. In addition to having an optimum conductivity of less than 10 pmho/cm, the liquid toner or developer of this invention also possesses a mobility of at least $-1.50\times10^{-10}$ $m^2/Vs$ and preferably $-2.00\times10^{-10}$ $m^2/Vs$ in embodiments.

It is still a further object of the invention to provide a liquid developer wherein developed image defects such as smearing, loss of resolution and loss of density are eliminated, or minimized.

Also, in another object of the present invention there are provided negatively charged liquid developers with certain zwitterionic quaternary ammonium AB diblock copolymer charge directors, which are superior in embodiments to, for example, quaternary ammonium block copolymers since, for example, they result in higher negative toner particle charge. The superior charge observed with, for example, a 1 percent solids cyan developer charged at 5 percent relative to the developer solids with the zwitterionic quaternary ammonium AB diblock copolymer charge director poly(2-ethylhexyl methacrylate-co-N,N-dimethyl-N-methylenecaroxylate-N-ammoniumethyl methacrylate) was $-2.42\times10^{-10}$ $m^2/Vs$ versus $-1.80\times10^{-10}$ $m^2/Vs$ for the corresponding cyan developer charged at the same level with the quaternary ammonium block copolymer charge director poly(2-ethylhexyl methacrylate-co-N,N,N-trimethyl-N-ethyl methacrylate ammonium bromide). Similarly, superior charge ($-2.30\times10^{-10}$ $m^2/Vs$) was observed for a 1 percent solids magenta developer charged at 9 percent relative to the developer solids with the zwitterionic quaternary ammonium AB diblock copolymer charge director poly(2-ethylhexyl methacrylate-co-N,N-dimethyl-N-methylenecarboxylate-N-ammoniumethyl methacrylate) versus the corresponding magenta developer ($-1.09\times10\times10$ $m^2/Vs$) charged at the same level with the quaternary ammonium block copolymer charge director poly(2-ethylhexyl methacrylate-co-N,N,N-trimethyl-N-ethyl methacrylate ammonium bromide). The superior charge can result in improved image development and excellent image transfer.

Also, in another object of the present invention there are provided negatively charged liquid developers with certain zwitterionic quaternary ammonium AB diblock copolymer charge directors, which are superior in embodiments to, for example, protonated ammonium AB diblock copolymers since, for example, they result in higher negative particle charge. The superior charge observed for a 1 percent solids cyan developer charged at 5 percent relative to the developer solids with the zwitterionic quaternary ammonium AB diblock copolymer charge director poly(2-ethylhexyl methacrylate-co-N,N-dimethyl-N-methylenecarboxylate-N-ammoniumethyl methacrylate) was $-2.42\times10^{-10}$ $m^2/Vs$ versus $-1.60\times10^{-10}$ $m^2/Vs$ for the corresponding cyan developer charged at the same level with the protonated ammonium AB diblock copolymer charge director poly(2-ethylhexyl methacrylate-co-N,N-dimethyl-N-ethyl methacrylate ammonium bromide). Similarly, superior charge ($-2.30\times10^{-10}$ $m^2/Vs$) was observed for a 1 percent solids magenta developer charged at 7 percent relative to the developer solids with the zwitterionic quaternary ammonium AB diblock copolymer charge director poly(2-ethylhexyl methacrylate-co-N,N-dimethyl-N-methylenecarboxylate-N-ammoniumethyl methacrylate) versus the corresponding magenta developer ($-1.53\times10^{-10}$ $m^2/Vs$) charged at the same level with the protonated ammonium AB diblock copolymer charge director poly(2-ethylhexyl methacrylate-co-N,N-dimethyl-N-ethyl methacrylate ammonium bromide). The superior charge can result in improved image development, excellent image transfer, and excellent image resolution.

Another object of the present invention resides in the provision of negatively charged liquid toners with quaternary ammonium block copolymers, which have been treated to enhance their functionality rendering them zwitterionic, and wherein in embodiments enhancement of the negative charge of NUCREL® based toners, especially cyan and magenta toners, is enhanced.

These and other objects of the present invention can be accomplished in embodiments by the provision of liquid developers with certain charge directors. In embodiments, the present invention is directed to liquid developers comprised of a toner resin, pigment, charge additive and a charge director comprised of a zwitterionic quaternary ammonium block copolymers wherein both cationic and anionic sites are covalently bonded within the same polar repeat unit in the polar A block of the block copolymer. In embodiments, the aforementioned charge director contains a polar zwitterionic quaternary ammonium A block and a second B block, constituent or component that is nonpolar thereby enabling hydrocarbon solubility, and which AB diblock copolymers can be obtained from group transfer polymerization, and a subsequent polymer modification reaction of the group transfer prepared AB diblock copolymer in which the zwitterionic site is introduced into the polar A block.

Embodiments of the present invention relate to a liquid electrostatographic developer comprised of (A) a nonpolar liquid having a Kauri-butanol value of from about 5 to about 30, and present in a major amount of from about 50 percent to about 95 weight percent; (B) thermoplastic resin particles with, for example, an average volume particle diameter of from about 0.5 to about 30 microns and preferably 1.0 to about 10 microns in average volume diameter; (C) a nonpolar liquid soluble zwitterionic quaternary ammonium AB diblock copolymer charge director wherein both cationic and anionic sites are covalently bonded within the same polar repeat unit in the polar A block of the block copolymer; and (D) optionally a charge adjuvant compound.

Suitable nonpolar liquid soluble charge director compound examples selected for the developers of the present invention in various effective amounts, such as from about 0.5 to about 100 weight percent of developer solids, which is also represented as 5 milligrams to about 1,000 mg of charge director solids to 1 gram of developer solids, and preferably 1 percent to 20 percent by weight relative to developer solids, or from about 10 milligrams to about 200 milligrams of charge director solids to 1 gram of developer solids, include zwitterionic AB diblock copolymers represented by the following formula

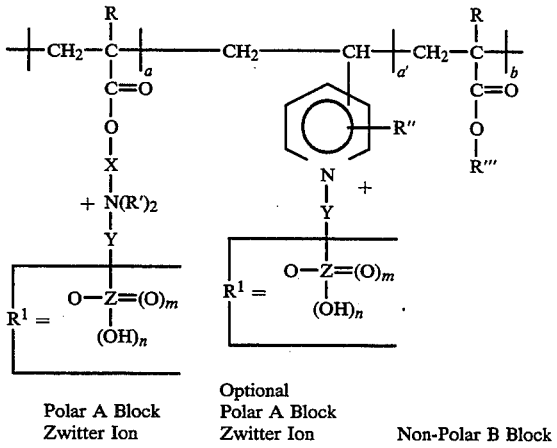

wherein R is hydrogen, alkyl, aryl, or alkylaryl; $R^1$ is a conjugate oxygen containing acid anion derived from carbon, sulfur, or phosphorus; Z is carbon (C), sulfur (S), phosphorus (P), or substituted phosphorus PR wherein R is as illustrated hereinbefore and m is 1 or 2 doubly bonded oxygen atoms and n is 0 or 1 hydroxyl groups; R' is alkyl, aryl, cycloalkyl, cycloalkylenyl cycloalkylalkyl, cycloalkylaryl or alkylaryl with or without heteroatoms; R'' is alkyl, aryl, cycloalkyl, cycloalkylalkyl, cycloalkylaryl or alkylaryl with or without heteroatoms; R''' is alkyl, aryl, cycloalkyl, cycloalkylalkyl, cycloalkylaryl or alkylaryl of 4 to 20 carbons with or without heteroatoms; X is alkylene or arylalkylene of, for example, about 2 to 10 carbons with or without heteroatoms and Y is alkylene or arylalkylene of 1 to 10 carbons with or without heteroatoms; $aM_a+a'M_{a'}$ is about 200 to 10,000 and $bM_b$ is 2,000 to 50,000 wherein a, a', and b is the number average degree of polymerization (DP) and $M_a$, $M_{a'}$, and $M_b$ is the corresponding repeat unit molecular weights. Alkyl includes groups with 1 to about 25 carbon atoms; aryl includes groups with from 6 to about 24 carbon atoms; and alkylene can include groups with from 1 to about 25 carbon atoms.

Examples of specific zwitterionic diblock copolymer charge directors include poly(2-ethylhexyl methacrylate-co-N,N-dimethyl-N-methylenecarboxylate-N-ammoniumethyl methacrylate), poly(2-ethylhexyl methacrylate-co-N,N-dimethyl-N-propylenesulfonate-N-ammoniumethyl methacrylate), poly(2-ethylhexyl methacrylate-co-N,N-dimethyl-N-propylenephosphonate-N-ammoniumethyl methacrylate), poly(2-ethylhexyl methacrylate-co-N,N-dimethyl-N-propylenephosphinate-N-ammoniumethyl methacrylate), poly(2-ethylhexyl methacrylate-co-N,N-dimethyl-N-propylenesulfinate-N-ammoniumethyl methacrylate), poly(2-ethylhexyl methacrylate-co-N,N-diethyl-N-methylenecarboxylate-N-ammoniumethyl methacrylate), poly(2-ethylhexyl methacrylate-co-N,N-diethyl-N-propylenesulfonate-N-ammoniumethyl methacrylate), poly(2-ethylhexyl methacrylate-co-N,N-dimethyl-N-butylenephosphonate-N-ammoniumethyl methacrylate), poly(2-ethylhexyl methacrylate-co-N,N-dimethyl-N-decamethylenephosphonate-N-ammoniumethyl methacrylate), poly(2-ethylhexyl methacrylate-co-N,N-dimethyl-N-decamethylenephosphinate-N-ammoniumethyl methacrylate), poly(2-ethylhexyl methacrylate-co-N,N-dimethyl-N-butylenecarboxylate-N-ammoniumethyl methacrylate), poly(2-ethylhexyl methacrylate-co-N,N-dimethyl-N-ethyleneoxyethylenecarboxylate-N-ammoniumethyl methacrylate), poly(2-ethylhexyl methacrylate-co-N,N-dimethyl-N-ethyleneoxyethylenesulfonate-N-ammoniumethyl methacrylate), poly(2-ethylhexyl methacrylate-co-N,N-dimethyl-N-ethyleneoxyethylenephosphonate-N-ammoniumethyl methacrylate), poly(N,N-dibutylmethacrylamido-co-N,N-dimethyl-N-methylenecarboxylate-N-ammoniumethyl methacrylate), poly(N,N-dibutylmethacrylamido-co-N,N-dimethyl-N-propylenesulfonate-N-ammoniumethyl methacrylate), poly(N,N-dibutylmethacrylamido-co-N,N-dimethyl-N-propylenephosphonate-N-ammoniumethyl methacrylate), poly(N,N-dibutylmethacrylamido-co-N,N-dimethyl-N-propylenephosphinate-N-ammoniumethyl methacrylate), and poly(N,N-dibutylmethacrylamido-co-N,N-dimethyl-N-propylenesulfinate-N-ammoniumethyl methacrylate). In all of the above examples, the corresponding acrylate copolymer, instead of the methacrylate copolymer, could also be employed as suitable nonpolar liquid soluble zwitterionic AB diblock copolymer charge directors. Additional suitable examples of nonpolar liquid soluble zwitterionic AB diblock copolymer charge directors include poly(4-vinylpyridinium-N-methylenecarboxylate-co-2-ethylhexyl methacrylate), poly(4-vinylpyridinium-N-propylenesulfonate-co-2-ethylhexyl methacrylate), poly(4-vinylpyridinium-N-propylenephosphonate-co-2-ethylhexyl methacrylate), poly(4-vinylpyridinium-N-propylenephosphinate-co-2-ethylhexyl methacrylate), poly(4-vinylpyridinium-N-propylenesulfinate-co-2-ethylhexyl methacrylate), poly(4-vinylpyridinium-N-ethyleneoxyethylenecarboxylate-co-2-ethylhexyl methacrylate), poly(4-vinylpyridinium-N-ethyleneoxyethylenesulfonate-co-2-ethylhexyl methacrylate), poly(4-vinylpyridinium-N-ethyleneoxyethylenephosphonate-co-2-ethylhexyl methacrylate), and poly[4-vinylpyridinium-N-methylenecarboxylate-co-p-tert butylstyrene) and the like. In the aforementioned pyridinium examples, additional examples of nonpolar liquid soluble zwitterionic AB diblock copolymer charge directors include poly(2-vinylpyridinium-N-methylenecarboxylate-co-2-ethylhexyl methacrylate), poly(2-vinylpyridinium-N-propylenesulfonate-co-2-ethylhexyl methacrylate), poly(2-vinylpyridinium-N-propylenephosphonate-co-2-ethylhexyl methacrylate), poly(2-vinylpyridinium-N-propylenephosphinate-co-2-ethylhexyl methacrylate), poly(2-vinylpyridinium-N-propylenesulfinate-co-2-ethylhexyl methacrylate), poly(2-vinylpyridinium-N-ethyleneoxyethylenecarboxylate-co-2-ethylhexyl methacrylate), poly(2-vinylpyridinium-N-ethyleneoxyethylenesulfonate-co- 2-ethylhexyl methacrylate), poly(2-vinylpyridinium-N-ethyleneoxyethylenephosphonate-co-2-ethylhexyl methacrylate), poly[3-vinylpyridinium-N-methylenecarboxylate-co-p-tertiary butylstyrene) and poly(3-vinylpyridinium-N-methylenecarboxylate-co-2-ethylhexyl methacrylate), poly(3-vinylpyridinium-No-propylenesulfonate-co-2ethylhexyl methacrylate), poly(3-vinylpyridinium-N-propylenephosphonate-co-2-ethylhexyl methacrylate), poly(3-vinylpyridinium-N-propylenephosphinate-co-2-ethylhexyl methacrylate), poly(3-vinylpyridinium-N-propylenesulfinate-co-2-ethylhexyl methacrylate), poly(3-vinylpyridinium-N-ethyleneoxyethylenecarboxylate-co-2-ethylhexyl methacrylate), poly(3-vinylpyridinium-ethyleneoxyethylenesulfonate-co-2-ethylhexyl methacrylate), poly(3-vinylpyridinium-N-ethyleneoxyethylenephosphonate-co-2-ethylhexyl methacrylate), and poly[3-vinylpyridinium-N-methylenecarboxylate-co-p-tert butylstyrene) and the like.

One preferred zwitterionic quaternary ammonium AB diblock copolymer charge director of the present invention contains (1) a polar A block which contains the positive quaternary ammonium nitrogen; and (2) a nonpolar B block which has sufficient aliphatic content to enable the block copolymer to more effectively dissolve in the nonpolar liquid having a Kauri-butanol value of less than about 30, and in embodiments from about 5 to about 30. The A block has a number average molecular weight range of from about 200 to about 10,000, and the B block has a number average molecular weight range of from about 2,000 to 50,000. Assuming an average $M_0$ of about 200 for both the A and B monomers, the above A block molecular weight ranges provide for a DP of about 1 to about 50 and the above B block molecular weight ranges provide for a DP of about 10 to about 250. Based on the above range of number average degree of polymerization (DP) for the polar A block, the mole percent of polar A block repeat units in the charge director AB diblock copolymers of this invention can satisfactorily range from 0.4 to 83.3 percent. Based on the above range of number average degree of polymerization (DP) for the nonpolar B block, the mole percent of nonpolar B block repeat units in the charge director AB diblock copolymers of this invention can satisfactorily range from 16.7 to 99.6 percent. The preferred repeat unit content of the polar A block is 60 to 5 mole percent and is more preferably at 40 to 10 mole percent, and the preferred repeat unit content of the nonpolar B block is 40 to 95 mole percent and is more preferably at 60 to 90 mole percent. Amine nitrogen alkylation to form the zwitterionic quaternary ammonium polar A block repeat unit wherein both cationic and anionic sites are covalently bonded within the same polar repeat unit should be at least 80 mole percent and preferably at least 90 mole percent for satisfactory charge director performance. The polar A block may be comprised entirely of either of the polar blocks illustrated herein or it may be complex wherein the optional polar A block repeat unit may be 0.1 to 99.9 mole percent of all the polar A block repeat units present. The complex polar A block may be segmented, tapered or random when it contains more than one repeat unit.

In another embodiment, the AB zwitterionic quaternary ammonium diblock charge director is composed of A and B blocks as described hereinafter. The polar A block is an alkyl, aryl or alkylaryl amine containing polymer wherein the alkyl, aryl, or alkylaryl moiety can be substituted or unsubstituted and be cyclic or noncyclic. Useful A blocks are polymers prepared from at least one monomer selected from the group consisting of 1) $CH_2{=}CRCO_2R^1$ wherein R is hydrogen, alkyl, aryl, or alkylaryl, and $R^1$ is a conjugate acid anion wherein m=0 to 2 and n=0 to 2, and Z is carbon, sulfur, or phosphorus. Specific examples of $R^1$ groups include carboxylate, sulfonate, sulfinate, phosphonate, phosphinate, phosphate and sulfate. X and Y are alkylene or arylalkylene with or without heteroatoms wherein Z contains 2 to 10 carbon atoms and Y contains 1 to 10 carbon atoms. Examples of X groups include 1,2-ethylene, 1,3-propylene, 1,2-propylene, 1,4-butylene, 1,6-hexylene, 1,10-decamethylene, 3,3,5,5-tetramethylhexylene, 1,4- cis or trans dimethylenecyclohexylene, 1,4-phenylenedimethylene, and 1-ethyleneoxy-5-ethylene. Examples of Y groups include methylene, 1-ethylene-2-oxy and all of the above cited X groups. R' is alkyl, aryl, cycloalkyl, cycloalkylenyl, cycloalkylalkyl, cycloalkylaryl or alkylaryl of 1 to 20 carbons with or without heteroatoms. Suitable R' groups include methyl, ethyl, allyl, hexyl, lauryl, cetyl, stearyl, 2-ethoxyethyl, benzyl, phenethyl, 1-methylenenaphthyl, cyclohexyl, cyclohexylmethylene, cyclopentylene, cyclohexylene, 4-ethylcyclohexyl, 4-cyclohexylbenzyl, 4-ethylbenzyl, 4-methoxybenzyl, and 4-nitrobenzyl. R'' is alkyl, aryl, cycloalkyl, cycloalkylalkyl, cycloalkylaryl or alkylaryl with or without heteroatoms. Suitable R'' groups include methyl, ethyl, allyl, butyl, isoamyl, methoxyl, phenyl, benzyl and cyclohexyl.

Examples of useful polar A block monomers selected in the preferred monomer range of 60 to 5 mole percent, which after copolymerization to unquaternized A block precursors that are subsequently quaternized to zwitterionic quaternary ammonium polar A block copolymers, include N,N-dimethylamino-N-2-ethylmethacrylate, N,N-diethylamino-N-2-ethylmethacrylate, N,N-dimethylamino-N-2-ethylacrylate, N,N-diethylamino-N-2-ethylacrylate, N-morpholino-2-ethyl methacrylate, 4-vinylpyridine, 3-vinylpyridine, and 2-vinylpyridine. Examples of monomers which after copolymerization give useful A blocks directly include N,N,dimethyl-N-methylenecarboxylate-N-ammoniumethyl methacrylate, N,N-diethyl-N-methylenecarboxylate-N-ammoniumethyl methacrylate, N,N-dimethyl-N-propylenesulfonate-N-ammoniumethyl methacrylate, N,N,dimethyl-N-methylenecarboxylate-N-ammoniumethyl acrylate, N,N-dimethyl-N-propylenesulfonate-N-ammoniumethyl acrylate, N,N-dimethyl-N-butylenephosphonate-N-ammoniumethyl methacrylate, N,N-dimethyl-N-butylenephosphinate-N-ammoniumethyl methacrylate, N,N-morpholino-N-methylenecarboxylate-N-ammoniumethyl methacrylate, N,N-morpholino-N-propylenesulfonate-N-ammoniumethyl methacrylate, 4-vinyl-N-methylene pyridinium carboxylate, 4-vinyl-N-propylenepyridinium sulfonate, 4-vinyl-N-butylenepyridinium phosphonate, 2-vinyl-N-methylene pyridinium carboxylate, 3-vinyl-N-methylene pyridinium carboxylate, and the like.

Examples of useful nonpolar B block monomers selected in the preferred range of 40 to 95 mole percent provide polymers prepared from at least one B block monomer selected from the group consisting of butadiene, isoprene, chloroprene, myrcene, and compounds of the general formulas $CH_2=CHR'''$, $CH_2=CHCO_2R'''$, $CH_2=CRCO_2R'''$, where R''' is alkyl, aryl, cycloalkyl, cycloalkylalkyl, cycloalkylaryl or alkylaryl with or without heteroatoms of 4 to 20 carbons. Examples of monomers useful in preparing the B blocks include 2-ethylhexyl methacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, chloroprene, mycrene, 1-dodecene, p-tertiary butylstyrene, etc. Optional useful nonpolar B blocks are polymers prepared from at least one monomer selected from the group consisting of $CH_2=CHCON(R')_2$ and $CH_2=CRCON(R')_2$ where R and R' are as indicated herein.

The charge director can be selected for the liquid developers in various effective amounts, such as for example from about 0.5 percent to 100 percent by weight relative to developer solids and preferably 1 percent to 20 percent by weight relative to developer solids. Developer solids include toner resin, pigment, and optional charge adjuvant. Without pigment, the developer may be selected for the generation of a resist, or a printing plate, etc.

Examples of liquid carriers or vehicles selected for the developers of the present invention include a liquid with viscosity of from about 0.5 to about 500 centipoise, and preferably from about 1 to about 20 centipoise, and a resistivity greater than or equal to $5\times10^9$ ohm/centimeters, such as $10^{13}$ ohm/cm or more. Preferably, the liquid selected in embodiments is a branched chain aliphatic hydrocarbon. A nonpolar liquid of the ISOPAR® series available from the Exxon Corporation may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX® resins, E. I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid; and at least one alkyl ester of acrylic or methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE® acrylic resins (E. I. DuPont de Nemours and Company); or blends thereof. Preferred copolymers are the copolymer of ethylene and an $\alpha$-$\beta$-ethylenically unsaturated acid of either acrylic acid or methacrylic acid. In a preferred embodiment, NUCREL® like NUCREL® 599, NUCREL® 699, or NUCREL® 960 can be selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference, and more specifically, the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, Cl 77266 |
| UHLICH ® BK 8200 | Paul Uhlich | Black |

To increase the toner particle charge and, accordingly, increase the mobility and transfer latitude of the toner particles, charge adjuvants can be added to the toner. For example, adjuvants, such as metallic soaps like aluminum or magnesium stearate or octoate, fine particle size oxides, such as oxides of silica, alumina, titania, and the like, paratoluene sulfonic acid, and polyphosphoric acid may be added. Negative charge adjuvants increase the negative charge of the toner particle, while the positive charge adjuvants increase the positive charge of the toner particles. With the invention of the present application, the adjuvants or charge additives can be comprised of the metal catechol and aluminum hydroxyacid complexes illustrated in U.S. Pat Nos. 5,306,591 and 5,308,731, the disclosures of which are totally incorporated herein by reference, and which additives in combination with the charge directors of the present invention have the following advantages over the aforementioned prior art charge additives: improved toner charging characteristics, namely an increase in particle charge, as measured by ESA mobility, from $-1.4$ E-10 $m^2/Vs$ to $-2.3$ E-10 $m^2/Vs$, that results in improved image development and transfer, from 80 percent to 93 percent, to allow improved solid area coverage, from transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions because the measurements can be made at high volume loadings, for example, greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin, nonpolar liquid charging additive and colorant in a manner that the resulting mixture contains, for example about 15 to about 30 percent by weight of solids; heating the mixture to a temperature from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; and diluting the dispersion, followed by mixing with the charge director.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media is particularly useful when colorants other than black are used. A typical diameter range for the particulate media is in the range of 0.04 to 0.5 inch (approximately 1.0 to approximately 13 millimeters).

Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of developers that can be selected are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. Pat. No. 5,306,591 the disclosure of which is totally incorporated herein by reference, the image is developed with the liquid toner illustrated herein by, for example, immersion of the photoconductor therein, followed by transfer and fixing of the image.

The invention will further be illustrated in the following nonlimiting Examples, it being understood that these Examples are intended to be illustrative only and that the invention is not intended to be limited to the materials, conditions, process parameters and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of −26 mv for a 10 percent (v/v) suspension of LUDOX TM (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzer manufactured by Horiba Instruments, Inc., Irvine, Calif.

Specific embodiments of the invention will now be described in detail. These Examples are intended to be illustrative, and the invention is not limited to the materials, conditions, or process parameters set forth in these embodiments. All parts and percentages are by weight unless otherwise indicated. Control Examples are also provided.

EXAMPLE I

Liquid Toner Preparation 1

One hundred and seventy five (175.0) grams of NUCREL 599 ®, a copolymer of ethylene and methacrylic acid with a melt index at 190° C. of 500 dg/minute, available from E. I. DuPont de Nemours & Company, Wilmington, Del., 45.4 grams of the cyan pigment PV FAST BLUE TM, 6.8 grams of aluminum stearate WITCO 22 TM, available from Witco Company, and 307.4 grams of NORPAR 15 ®, carbon chain of 15 average (available from Exxon Corporation), were added to a Union Process 15 attritor (Union Process Company, Akron, Ohio) charged with 0.1875 inch (4.76 millimeters) diameter carbon steel balls. The mixture was milled in the attritor which was heated with running steam through the attritor jacket at 86° C. to 96° C. for 2 hours and cooled by running water through the attritor jacket to 16° C., an additional 980.1 grams of NORPAR 15 ® was added, and ground in the attritor for an additional 4.5 hours. An additional 1,536 grams of NORPAR 15 ® were added and the mixture was separated by the use of a metal grate from the steel balls yielding a liquid toner concentrate of 7.13 percent solids. The particle diameter was 2.12 microns average by area as measured with a Horiba Cappa 500.

EXAMPLE II

Liquid Toner Preparation 2

One hundred and seventy point four (170.4) grams of NUCREL 599 ® (a copolymer of ethylene and methacrylic acid with a melt index at 190° C. of 500 dg/minute, available from E. I. DuPont de Nemours & Company, Wilmington, DE), 50.0 grams of the magenta pigment FANAL PINK TM, 6.8 grams of aluminum stearate WITCO 22 TM (Witco) and 307.4 grams of NORPAR 15 ® carbon chain of 15 average (Exxon Corporation), were added to a Union Process 1S attritor (Union Process Company, Akron, Ohio) charged with 0.1875 inch (4.76 millimeters) diameter carbon steel balls. The mixture was milled in the attritor, which was heated with running steam through the attritor jacket at 85° C. to 96° C. for 2 hours and cooled by running water through the attritor jacket to 15° C.; an additional 980.1 grams of NORPAR 15 ® were added, and ground in the attritor for an additional 4.5 hours. An additional 1,532 grams NORPAR 15 ® were added and the mixture was separated by the use of a metal grate from the steel balls yielding 7.17 percent solids liquid toner concentrate. The particle diameter was 2.18 micrometers average by area as measured with the Horiba Cappa 500.

EXAMPLE III

Liquid Toner Preparation 3

One hundred and sixty five point three (165.3) grams of NUCREL 599 ® (a copolymer of ethylene and methacrylic acid with a melt index at 190° C. of 500 rig/minute, available from E. I. DuPont de Nemours & Company, Wilmington, Del.), 56.8 grams of the magenta pigment FANAL PINK TM, 5.1 grams of aluminum stearate WITCO 22 TM (Witco) and 307.4 grams of NORPAR 15 ® carbon chain of 15 average (Exxon Corporation), were added to a Union Process 1S attritor (Union Process Company, Akron, Ohio) charged with 0.1875 inch (4.76 millimeters) diameter carbon steel balls. The mixture was milled in the attritor, which was heated with running steam through the attritor jacket at 83° C. to 96° C. for 2 hours and cooled by running water through the attritor jacket to 23° C.; an additional 980.1 grams of NORPAR 15 ® were added, and ground in the attritor for an additional 4.5 hours. An additional 1,532 grams NORPAR 15 ® were added and the mixture was separated by the use of a metal grate from the steel balls yielding 7.19 percent solids liquid toner concentrate. The particle (toner) diameter was 2.02 microns average by area as measured with the Horiba Cappa 500.

EXAMPLE IV

Base Polymer Preparation 1

Sequential group transfer polymerization (GTP) of 2-ethylhexyl methacrylate (EHMA) and 2-dimethylaminoethyl methacrylate (DMAEMA) was used to prepare the AB diblock copolymer precursor, poly(2-ethylhexyl methacrylate-co-N,N-dimethylamino-N-ethyl methacrylate), of the zwitterionic block copolymer charge directors.

AB diblock copolymer precursors were prepared by a standard group transfer sequential polymerization procedure (GTP) wherein the ethylhexyl methacrylate monomer was first polymerized to completion and then the 2-dimethylaminoethyl methacrylate monomer was polymerized onto the living end of the ethylhexyl methacrylate polymer. All glassware was first baked out in an air convection oven at about 120° C. for about 16 to 18 hours.

A 2 liter 3-neck round bottom flask equipped with a magnetic stirring football, an Argon inlet and outlet, and a neutral alumina (150 grams) column (later to be replaced by a rubber septum and then a liquid dropping funnel) was charged through the alumina column, which was maintained under a positive Argon flow and sealed from the atmosphere, with 415 grams (2.093 mole) of freshly distilled 2-ethylhexyl methacrylate (EHMA) monomer. Next, 500 milliliters of freshly distilled tetrahydrofuran solvent, distilled from sodium benzophenone, were rinsed through the same alumina column into the polymerization vessel. Subsequently, the GTP initiator, 26 milliliters of methyl trimethylsilyl dimethylketene acetal (22.31 grams; 0.1280 mole) was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.1 milliliter of a 0.66M solution of tetrabutylammonium acetate (catalyst) in the same dry tetrahydrofuran was syringed into the polymerization vessel. After an additional hour stirring under Argon, the polymerization temperature peaked at about 50° C. Shortly thereafter, 90 grams (0.572 mole) of freshly distilled 2-dimethylaminoethyl methacrylate (DMAEMA) monomer was dropwise added to the polymerization vessel. The polymerization solution was stirred under Argon for at least 4 hours after the temperature peaked. Then, 5 milliliters of methanol were added to quench the live ends of the fully grown copolymer. The above charges of initiator and monomers provided an Mn and average degree of polymerization (DP) for each block. For the EHMA nonpolar B block, the charged $M_n$ was 3,243 and the DP was 16.4 and for the DMAEMA polar A block, the charged $M_n$ was 703 and the DP was 4.5. $^1$H-NMR analysis of a 20 percent (g/dl) $CDCl_3$ solution of the copolymer indicated a 77 to 78 mole percent EHMA content and a 22 to 23 mole percent DMAEMA content. GPC analysis was obtained on a portion of the 1 to 2 gram sample of isolated polymer using three 250×8 millimeters of PHENOMENEX PHENOGEL TM columns in series (100, 500, 1,000 Angstroms) onto which was injected a 10 microliter sample of the block copolymer at 1 percent (weight/volume) in THF. The sample was eluted with THF at a flow rate of 1 milliliter/minute and the chromatogram was detected with a 254 nanometer UV detector. GPC analysis indicated the major peak at 14.5 to 19.9 counts to have a polystyrene equivalent number average molecular weight of 3,912 and a weight average molecular weight of 6,222 (MWD of 1.59). Two barely discernible broad low molecular weight peaks were located at 20 to 25.1 and 25.1 to 30 counts.

A small (1 to 2 grams) portion of the AB diblock copolymer can be isolated for GPC and $^1$H-NMR analyses by precipitation into 10X its solution volume of methanol using vigorous mechanical agitation. The precipitated copolymer was then washed on the funnel with more methanol and was then dried overnight in vacuo (about 0.5 Torr) at about 50° C.

The AB diblock copolymer prepared above was not isolated but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Subsequently, toluene was added to provide a solution of the block copolymer at any desired solids level.

EXAMPLE V

Base Polymer Preparation 2

This EHMA-DMAEMA AB diblock copolymer precursor, poly(2-ethylhexyl methacrylate-co-N,N-dimethylamino-N-ethyl methacrylate), to the zwitterionic charge directors was prepared by a standard group transfer sequential polymerization procedure (GTP) as described in Example IV. Instead of adding 26 milliliters of methyl trimethylsilyl dimethylketene acetal initiator as was added in base polymer preparation 1, 15 milliliters (12.87 grams; 0.0738 mole) of the initiator were syringed into the polymerization vessel. Otherwise, the amounts of monomers, solvent, catalyst, quencher and the reaction temperatures and times were the same as in base polymer preparation 1. The above charges of initiator and monomers provided an $M_n$ and average degree of polymerization (DP) for each block. For the EHMA nonpolar B block, the charged $M_n$ was 5,621 and the DP was 28.3, and for the DMAEMA polar A block, the charged $M_n$ was 1,219 and the DP was 7.8. $^1$H-NMR analysis of a 20 percent (g/dl) $CDCl_3$ solution of the copolymer indicated a 77 to 78 mole percent EHMA content and a 22 to 23 mole percent DMAEMA content. GPC analysis was obtained on about 100 milligrams of the 1 to 2 gram sample of isolated polymer using three 250×8 millimeters PHENOMENEX PHENOGEL TM columns in series (100, 500, 1,000 Angstroms) onto which was injected a 10 microliter sample of the block copolymer at 1 percent (weight/volume) in THF. The sample was eluted with THF at a flow rate of 1 milliliter/minute and the chromatogram was detected with a 254 nanometer UV detector. The GPC chromatogram was bimodal with the major peak occurring at 13.4 to 22.2 counts and the minor low molecular weight peak at 23.5 to 28.3 counts. The major peak has a polystyrene equivalent number average molecular weight ($M_n$) of 2,346 and a weight average molecular weight ($M_w$) of 8,398 (MWD=3.58). This GPC analysis of the AB diblock copolymer indicated the presence of low molecular weight oligomeric impurities. However, the low molecular weight GPC peak components did not appear to impair the charge director function of the subsequently prepared zwitterionic AB diblock copolymer charge directors of the present invention.

A small (1 to 2 grams) portion of the AB diblock copolymer can be isolated for GPC and $^1$H-NMR analyses by precipitation into 10 times its solution volume of methanol using vigorous mechanical agitation. The precipitated copolymer was then washed on the funnel with more methanol and was then dried overnight in vacuo (about 0.5 Torr) at about 50° C.

The AB diblock copolymer prepared above was not isolated but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Subsequently, toluene was added to provide about a 50 percent by weight solution of the block copolymer.

EXAMPLE VI

Base Polymer Preparation 3

An AB diblock copolymer, poly(2-ethylhexyl methacrylate-co-N,N-dimethylamino-N-ethyl methacrylate), was prepared as described in Example IV using the same polymerization procedure and conditions except the polymerization scale was increased by a factor of three. $^1$H-NMR analysis of a 17.5 percent (grams/dl) $CDCl_3$ solution of an isolated portion of the AB diblock copolymer indicated about a 77 to 78 mole percent EHMA repeat unit content and a 22 to 23 mole percent DMAEMA repeat unit content. GPC analysis, as described in polymer preparation 1, indicated the major peak at 14.4 to 22.6 counts to have a polystrene equivalent number average molecular weight of 2,253 and a weight average molecular weight of 5,978 (MWD of 2.65). A broad low molecular weight peak was located at 24 to 32 counts.

EXAMPLE VII

Charge Director Preparation 1

Preparation of the carboxylate zwitterion, poly(2-ethylhexyl methacrylate-co-N,N-dimethyl-N-methylenecarboxylate-N-ammoniumethyl methacrylate), from poly(2-ethylhexyl methacrylate-co-N,N-dimethylamino-N-ethyl methacrylate) prepared in Example V and sodium iodoacetate:

A 25 milliliter Erlenmeyer flask was charged with 8.18 grams of a 49 weight percent solution of base polymer 2 in toluene. The toluene solution contained 4.00 grams of base polymer 2 which contains about 0.78 gram (0.00497 mole) of 2-dimethylaminoethyl methacrylate (DMAEMA) repeat units. To this solution was added 0.94 gram (0.00452 mole) of sodium iodoacetate (Aldrich). Thus, about 90 mole percent of all the DMAEMA repeat units were targeted for conversion to the carboxylate zwitter ion. The mixture was magnetically stirred at ambient temperature and then at 55 to 60° C. on a hot plate. Since a clear solution did not form, 5 to 10 more milliliters of toluene and 6 to 7 milliliters of methanol were added, but the dispersion persisted. The methanol was evaporated and to the remaining dispersion were added 10 milliliters of N,N-dimethylformamide. The resulting solution was warmed at 55 to 60° C. for about 17 hours in the stoppered Erlenmeyer flask to give a mixture containing a gummy precipitate and a flocculant precipitate. The solids were vacuum filtered and then slurried with 65 to 70 milliliters of ethanol at 30 to 35° C. for 0.5 hour to extract the sodium iodide byproduct. The residual solid was vacuum filtered and was washed on the funnel 2 times with 25 milliliter portions of ethanol. The ethanol insolubles were dried in vacuo (0.4 to 0.6 millimeter Hg) at 50 to 55° C. for 17 hours to provide 2.83 grams (66 percent of theory) of poly(2-ethylhexyl methacrylate-co-N,N-dimethyl-N-methylenecarboxylate-N-ammoniumethyl methacrylate) as the solid zwitterionic charge director. The $^1$H-NMR analysis of the solid was missing the proton signal (6H at 2.23 ppm) of the gem dimethyl group on the unquaternized nitrogen of the precursor polymer prepared in Example V indicating that quaternization by the sodium iodoacetate was complete in the isolated sample. Polymer chains with incompletely quaternized DMAEMA repeat units were substantially soluble in the ethanol and were thereby extracted from the isolated sample. The new methylene (2H) signal in the poly(2-ethylhexyl methacrylate-co-N,N-dimethyl-N-methylenecarboxylate-N-ammoniumethyl methacrylate) product was concealed by the broad peak centered at 3.73 ppm (versus TMS as internal standard) assignable to hydrogens on all the carbon atoms bonded to the quaternized nitrogen. To 2.47 grams of solid poly(2-ethylhexyl methacrylate-co-N,N-dimethyl-N-methylenecarboxylate-N-ammoniumethyl methacrylate), which is equivalent to 2.30 grams of the polymer prepared in Example V, were added about 10 milliliters of toluene to rapidly dissolve the polymer and then 198 grams of NORPAR 15®. This solution was rotoevaporated for about 0.75 hour at 40 to 50° C. and 50 millimeters Hg to remove the toluene. The resulting charge director concentration in NORPAR 15® was about 1 weight percent. This NORPAR 15® charge director solution was used to charge liquid toners.

EXAMPLE VIII

Charge Director Preparation 2

Preparation of the sulfonate zwitter ion, poly(2-ethylhexyl methacrylate-co-N,N-dimethyl-N-propylenesulfonate-N-ammoniumethyl methacrylate), from poly(2-ethylhexyl methacrylate-co-N,N-dimethylamino-N-ethyl methacrylate) prepared in Example 4, and 1,3-propanesultone:

A three-neck 100 milliliter round bottom flask, equipped with a thermometer, a magnetic stirring football, an Argon inlet, and a water condenser with Argon outlet to a mineral oil bubbler to maintain a gentle positive flow of Argon over the contents of the reaction vessel was charged with 30 grams of the polymer solution (33.5 weight percent in toluene) from base polymer preparation 1. The toluene solution contained 10.05 grams of base polymer 1 which contained 1.67 grams (0.0106 mole) DMAEMA repeat units as determined from $^1$H-NMR analysis. To the polymer solution with stirring at about 40° C. was added 1.10 grams (0.0090 mole) of 1,3-propanesultone (Aldrich) from a freshly opened bottle as a 5 milliliter solution in toluene. The charged stoichiometry targets 85 mole percent of the DMAEMA repeat units for conversion to the corresponding propylenesulfonate zwitter ion. The solution was stirred under a gentle flow of Argon for 20 hours at 70° C. to 72° C. in a temperature controlled silicone oil bath to provide a solid mass. The sultone modified polymer absorbed toluene solvent which was substantially removed by drying in vacuo (about 0.3 millimeters Hg) for 17 hours at about 65° C. to give 11.65 grams (theory 11.15 grams) of solid charge director. The $^1$H-NMR spectrum of the poly(2-ethylhexyl methacrylate-co-N,N-dimethyl-N-propylenesulfonate-N-ammoniumethyl methacrylate) charge director in $CDCl_3$ solution contained a small intensity signal (2.15 ppm) assignable to the 6H protons of the gem dimethyl group in residual unquaternized DMAEMA repeat units. The decreased magnitude of this signal in the charge director versus the magnitude of the same signal of the polymer prepared in Example IV indicates that substantial quaternization by the 1,3-sultone was effected. The new propylene signal was concealed by the broad peak centered at about 3.79 ppm (versus TMS as internal standard). A 1 percent by weight NORPAR 15® charge director solution was prepared as described in Example VII. This NORPAR 15 ® charge director solution was used to charge liquid toners.

EXAMPLE IX

Charge Director Preparation 3

Preparation of the methyl bromide quaternized ammonium charge director, poly(2-ethylhexyl methacrylate-co-N,N,N-trimethyl-N-ethyl methacrylate ammonium bromide), from poly (2-ethylhexyl methacrylate-co-N,N-dimethylamino-N-ethyl methacrylate) prepared in Example VI and methylbromide:

To a 1 liter Erlenmeyer flask was added 150 grams of a 50.86 weight percent toluene solution of an AB diblock copolymer prepared in Example VI composed of 18.23 weight percent 2-dimethylaminoethyl methacrylate (DMAEMA) repeat units and 81.77 weight percent 2-ethylhexyl methacrylate (EHMA) repeat units. The 76.29 grams of AB diblock copolymer in the above toluene solution contained 13.91 grams (0.08846 mole) DMAEMA repeat units. To this magnetically stirred solution at room temperature were added an additional 207 grams of toluene to give a 21.4 percent copolymer solution and 46.2 milliliters (0.0924 mole) of a 2 M solution of methyl bromide in t-butyl methyl ether. The charged mole percent ratio of methyl bromide to DMAEMA repeat units is 104.5 mole percent so that all of the DMAEMA repeat units have been targeted for conversion to the methyl bromide quaternized AB diblock copolymer charge director. After stirring for 21 hours at ambient conditions in a stoppered Erlenmeyer flask, the clear solution was rotoevaporated for 2 hours at 50 to 55 ° C. and 30 to 50 millimeter Hg to remove the excess methyl bromide and toluene. The solid residue was dried in vacuo at 50 to 55° C. for 2.5 to 3.0 hours at about 0.3 millimeter Hg to provide 89.62 grams (theory 84.69 grams) of solid methyl bromide quaternized charge director containing 4.93 grams (5.5 weight percent) trapped toluene. $^1$H-NMR analysis indicated no unquaternized DMAEMA repeat units based on the absence of a hydrogen signal for the nitrogen gem dimethyl group. The copolymer composition was 26.34 weight percent (21.95 mole percent) DMAEMA repeat units and 73.66 weight percent (78.05 mole percent) EHMA repeat units.

The following phase transfer bromide ion exchange hydration treatment was carried out on the methyl bromide quaternary ammonium charge director described above. To a 1.5 liter beaker was added 10.00 grams of the untreated solid methyl bromide quaternized charge director plus 100 grams of toluene. The 10.00 grams is 9.45 grams solid charge director and 0.55 gram toluene and contains 2.49 grams (0.0099 mole) of DMAEMA repeat units. To the magnetically stirred solution of quaternized charge director in toluene was added a solution of sodium bromide (107.52 grams; 1.045 mole) in deionized water (275 grams) plus 0.065 gram of 40 percent aqueous tetra n-butylammonium hydroxide phase transfer catalyst. After stirring at ambient conditions for 21 hours, the two liquid layers were separated and the aqueous layer was re-extracted with 200 milliliters of toluene and the combined toluene layers were rotoevaporated to dryness. The residual solid was briefly swirled with 200 milliliters of deionized water which was decanted and then 200 milliliters of toluene were added and rotoevaporated away azeotropically removing loosely bound water, not water of hydration, from the solid residue. After drying in vacuo for 2.5 hours at 55° C. and 0.3 millimeter Hg, the solid charge director weighed 10.59 grams (theory 9.45 grams). This phase transfer bromide exchanged methyl bromide quaternized charge director contains about 10.8 percent trapped toluene/water. Accounting for trapped solvents, a charge director solution was prepared by dissolving 4.68 grams of the solid charge director in 417.8 grams of NORPAR 15 ® to give a 0.89 percent solution based on the corresponding weight of pre-quaternized AB diblock copolymer, poly (2-ethylhexyl methacrylate-co-N,N-dimethylamino-N-ethyl methacrylate) prepared in Example VI. This NORPAR 15 ® charge director solution was used to charge liquid toners.

EXAMPLE X

Charge Director Preparation 4

Preparation of the hydrogen bromide ammonium salt charge director, poly(2-ethylhexyl methacrylate-co-N,N-dimethyl-N-ethyl methacrylate ammonium bromide), from poly (2-ethylhexyl methacrylate-co-N,N-dimethylamino-N-ethyl methacrylate) prepared in Example VI and aqueous hydrogen bromide:

To a 1 liter Erlenmeyer flask were added 294.93 grams of a 50.86 weight percent toluene solution of an AB diblock copolymer (150 grams) from poly(2-ethylhexyl methacrylate-co-N,N-dimethylamino-N-ethyl methacrylate) prepared in Example VI comprised of 18.23 weight percent of 2-dimethylaminoethyl methacrylate (DMAEMA) repeat units and 81.77 weight percent of 2-ethylhexyl methacrylate (EHMA) repeat units. The 150 grams of AB diblock copolymer contains 27.35 grams (0.174 mole) of DMAEMA repeat units. To this magnetically stirred AB diblock copolymer toluene solution at about 20° C. were added 28.73 grams (0.170 mole of HBr) of 48 percent aqueous hydrobromic acid (Aldrich). A 2° C. exotherm was observed in the first 5 minutes, however, after the addition of 23.4 grams of methanol, an 8° C. exotherm was observed in the next five minutes and then the temperature of the contents of the reaction vessel slowly began to drop. To reduce the viscosity of the reaction mixture, 150 grams additional toluene were added to give a 33 weight percent solids solution of moderate viscosity. This solution was magnetically stirred for 20 hours at ambient temperature and was then diluted with NORPAR 15 ® (2,850 grams) to give a 5 weight percent charge director solution after toluene rotoevaporation based on the starting weight of the AB diblock copolymer, poly(2-ethylhexyl methacrylate-co-N,N-dimethylamino-N-ethyl methacrylate). Toluene was rotoevaporated at 50 to 60° C. for 1 to 2 hours at 40 to 50 millimeters Hg from 500 to 600 milliliter portions of the charge director solution until the entire sample was rotoevaporated. The 5 weight percent NORPAR 15 ® solution of poly(2-ethylhexyl methacrylate-co-N,N-dimethyl-N-ethyl methacrylate ammonium bromide) had a conductivity of 1,700 to 1,735 pmhos/cm and was used to charge liquid toner.

CONTROL 1

A magenta liquid toner dispersion was prepared by selecting 208.6 grams of liquid toner concentrate (7.19 percent solids in NORPAR 15 ®) from Example III and adding to it 1,246.4 grams of NORPAR 15 ®, and 45.0 grams of charge director poly(2-ethylhexyl methacrylate-co-N,N,N-trimethyl-N-ethyl methacrylate ammonium bromide) (1 percent solids in NORPAR 15 ®)

from Example IX. This resulted in a liquid toner dispersion of 1 percent solids and 30 milligrams of charge director to 1 gram of toner solids. After 1 week of equilibration, a test was conducted to determine the toner charging rate. The 1 percent toner was charged to a 90 milligrams/gram level, and the mobility and conductivity of the toner were measured after 1 day and compared to the corresponding values of the 1 percent toners charged in Examples XI, XII and XIII after 1 day. The results are presented in Table 1 below.

CONTROL 2

A magenta liquid toner dispersion was prepared by selecting 27.89 grams of liquid toner concentrate (7.17 percent solids in NORPAR 15 ®) from Example II and adding it to 168.51 grams of NORPAR 15 ®, and 3.6 grams of charge director poly(2-ethylhexyl methacrylate-co-N,N-dimethyl-N-ethyl methacrylate ammonium bromide) (5 percent solids in NORPAR 15 ®) from Preparation 4, Example X. This resulted in a magenta liquid toner dispersion (2A) of 1 percent solids and 90 milligrams of charge director to 1 gram of toner solids. The mobility and conductivity of the toner were measured after 2 days and compared to the corresponding values of the 1 percent toners charged in Examples XI, XII, and XIII after 1 day. The results are presented in Table 1 below.

CONTROL 3

A second magenta liquid toner dispersion was prepared by selecting another 27.89 grams of liquid toner concentrate (7.17 percent solids in NORPAR 15 ®) from Example II and adding it to 169.31 grams of NORPAR 15 ®, and 2.8 grams of charge director poly(2-ethylhexyl methacrylate-co-N,N-dimethyl-N-ethyl methacrylate ammonium bromide) (5 percent solids in NORPAR 15 ®) from Preparation 4, Example X. This resulted in a magenta liquid toner dispersion (2B) of 1 percent solids and 70 milligrams of charge director to 1 gram of toner solids. The mobility and conductivity of the toner were measured after 2 days and compared to the corresponding values of the 1 percent toners charged in Examples XI, XII, and XIII after 1 day. The results are presented in Table 1 that follows.

EXAMPLE XI

A magenta liquid toner dispersion was prepared by selecting 27.89 grams of liquid toner concentrate (7.17 percent solids in NORPAR 15 ®) from Example II and adding it to 154.11 grams of NORPAR 15 ®, and 18 grams of the invention charge director (1 percent solids in NORPAR 15 ®) from Example VII. This resulted in a magenta liquid toner dispersion (1A) of 1 percent solids and 90 milligrams of charge director to 1 gram of toner solids. The mobility and conductivity of the toner were measured and compared to the values of the toners in Controls 1 to 3 in Table 1.

EXAMPLE XII

A second magenta liquid toner magenta dispersion was similarly prepared by taking 27.89 grams of liquid toner concentrate (7.17 percent solids in NORPAR 15 ®) from Example II and adding it to 158.11 grams of NORPAR 15 ®, and 14.0 grams of the invention charge director (1 percent solids in NORPAR 15 ®) from Example VII. This resulted in a magenta liquid toner dispersion (1B) of 1 percent solids and 70 milligrams of charge director to 1 gram of toner solids. The mobility and conductivity of the toner were measured and compared to the values of the toners in Controls 1 to 3 in Table 1.

EXAMPLE XIII

A magenta liquid toner dispersion was prepared by taking another 27.89 grams of liquid toner concentrate (7.17 percent solids in NORPAR 15 ®) from Example II and adding it to 154.11 grams of NORPAR 15 ®, and 18.0 grams of the invention charge director (1 percent solids in NORPAR 15 ®) from Example VIII. This resulted in a magenta liquid toner dispersion (1C) of 1 percent solids and 90 milligrams of charge director to 1 gram of toner solids. The mobility and conductivity of the toner were measured and compared to the values of the toners in Controls 1 to 3 in Table 1.

After 1 day of equilibration, a test was conducted to determine the toner charging level and the conductivity of 1 percent liquid toner dispersions in Examples XI, XII and XIII. The results are presented in Table 1 below. Examples XI and XII indicate that the methylenecarboxylate zwitter ion quaternized ammonium charge director in one day charged magenta toner to greater than twice the charging level of the methyl bromide quaternized ammonium charge director (Control 1) also in one day, and that the methylenecarboxylate zwitter ion quaternized ammonium charge director effects this higher charging level at a conductivity less than or equal to 50 percent of Control 1. Comparing Examples XI and XII after 1 day of charging to Controls 2 and 3 after 2 days of charging, indicated toner charging remains considerably higher (about 50 percent) for Examples XI and XII, and that the conductivities were at least 50 percent lower for Examples XI and XI. Example XIII shows that the propylenesulfonate zwitter ion quaternized ammonium charge director in one day chargewere d magenta toner about 33 percent higher than the charging level of the methyl bromide quaternized ammonium charge director (control 1) and that the propylenesulfonate zwitter ion quaternized ammonium charge director effected this higher charging level at a conductivity of only 11 percent of Control 1. Comparing Example XIII after 1 day of charging to Control 2 after 2 days of charging indicated toner charging to be slightly higher for Control 2, which may be due to the 1 day longer charging period for Control 2, but conductivity for Example XIII to be only about 10 percent that of Control 2.

TABLE 1

| | Magenta Liquid Developers | | | | |
|---|---|---|---|---|---|
| EXAMPLE | Equilibration Time in Days | Charge Director Level in mg/g | Mobility E− 10 $m^2/Vs$ | Cond. pmho/cm | Comments |
| Control 1 | 1 | 90/1 | −1.09 | 18 | Low Charging & High Conductivity |
| Control 2 | 2 | 90/1 | −1.55 | 19 | Low Charging & |

TABLE 1-continued

| EXAMPLE | Equilibration Time in Days | Magenta Liquid Developers Charge Director Level in mg/g | Mobility E− 10 $m^2/Vs$ | Cond. pmho/cm | Comments |
|---|---|---|---|---|---|
| Control 3 | 2 | 70/1 | −1.53 | 12 | High Conductivity Low Charging & High Conductivity |
| Example XI | 1 | 90/1 | −2.30 | 9 | High Charging & Low Conductivity |
| Example XII | 1 | 70/1 | −2.30 | 6 | High Charging & Low Conductivity |
| Example XIII | 1 | 90/1 | −1.46 | 2 | Low Charging & Very Low Conductivity |

Control 4

A cyan liquid toner dispersion was prepared by selecting 28.05 grams of liquid toner concentrate (7.13 percent solids in NORPAR 15®) from Example I and adding to it 161.95 grams of NORPAR 15®, and 10.0 grams of charge director poly(2-ethylhexylmethacrylate-co-N,N,N-trimethyl-N-ethyl methacrylate ammonium bromide) (1 percent solids in NORPAR 15®) from Example IX. This resulted in a cyan liquid toner dispersion of 1 percent solids and 50 milligrams of charge director to 1 gram of toner solids. The mobility and conductivity of the toner were measured after 2 days of charging and compared to the corresponding values of the 1 percent toners of Example XIV after 1 day. The results are presented in Table 3 below.

Control 5

A cyan liquid toner dispersion was prepared by selecting 28.05 grams of liquid toner concentrate (7.13 percent solids in NORPAR 15®) from Example I and adding it to 169.95 grams of NORPAR 15®, and 2.0 grams of charge director poly(2-ethylhexyl methacrylate-co-N,N-dimethyl-N-ethyl methacrylate ammonium bromide) (5 percent solids in NORPAR 15®) from Preparation 4, Example X. This resulted in a cyan liquid toner dispersion (4A) of 1 percent solids and 50 milligrams of charge director to 1 gram of toner solids. The mobility and conductivity of the toner were measured after 2 days and compared to the corresponding values of the 1 percent toners of Example XIV after 1 day. The results are presented in Table 3 below.

Control 6

A cyan liquid toner dispersion was prepared by selecting 28.05 grams of liquid toner concentrate (7.13 percent solids in NORPAR 15®) from Example I and adding it to 169.15 grams of NORPAR 15®, and 2.8 grams of charge director poly(2-ethylhexyl methacrylate-co-N,N-dimethyl-N-ethyl methacrylate ammonium bromide) (5 percent solids in NORPAR 15®) from Preparation 4, Example X. This resulted in a cyan liquid toner dispersion of 1 percent solids and 70 milligrams of charge director to 1 gram of toner solids. The mobility and conductivity of the toner were measured after 2 days and compared to the corresponding values of the 1 percent toners of Example XIV after 1 day. The results are presented in Table 3 below.

Control 7

A cyan liquid toner dispersion was prepared by selecting 28.05 grams of liquid toner concentrate (7.13 percent solids in NORPAR 15®) from toner Example I and adding it to 168.35 grams of NORPAR 15®, and 3.6 grams of charge director poly(2-ethylhexyl methacrylate-co-N,N-dimethyl-N-ethyl methacrylate ammonium bromide) (5 percent solids in NORPAR 15®) from Preparation 4, Example X. This resulted in a cyan liquid toner dispersion (4C) of 1 percent solids and 90 milligrams of charge director to 1 gram of toner solids. The mobility and conductivity of the toner were measured after 2 days and compared to the corresponding values of the 1 percent toners of Example XIV after 1 day. The results are presented in Table 3 below.

EXAMPLE XIV

Six cyan liquid toner dispersions at 1 percent solids in NORPAR 15® were prepared by mixing the components in Table 2 below wherein each zwitterionic charge director was used to charge the cyan toners at three different charge director levels.

After charge equilibrating for 1 day, a test was conducted to determine the charging level and the conductivity of the six (Examples XIVA to F) 1 percent liquid cyan toner dispersions formulated in Table 2 versus the 1 percent cyan toner dispersion Controls 4 to 7 which were equilibrated for 2 days after charging. The results are presented in Table 3 below. Clearly the cyan liquid toner charging level, as measured by the indicated ESA mobilities, in all Examples in Table 3, exceed the mobilities of the control cyan toner dispersions indicating that both the methylenecarboxylate zwitter ion quaternized ammonium charge director and the propylenesulfonate zwitter ion quaternized ammonium charge director charge cyan liquid toner more effectively at comparable charge director levels than do poly(2-ethylhexyl methacrylate-co-N,N,N-trimethyl-N-ethyl methacrylate ammonium bromide), and poly(2-ethylhexyl methacrylate-co-N,N-dimethyl-N-ethyl methacrylate ammonium bromide), the charge directors in the control cyan liquid toner dispersions. Also, in all the Examples of Table 3, the conductivities of the exemplified cyan liquid toners were lower than the conductivities of the control cyan liquid toner dispersions when charged at the same charge director level. The propylenesulfonate zwitter ion quaternized ammonium charge director affords cyan toners with slightly lower mobilities than does the methylenecarboxylate zwitter ion quaternized ammonium charge director, but the sulfonate zwitter ion charged cyan liquid toners provided lower conductivities than the carboxylate zwitter ion charged cyan liquid toners when charged at the same charge director level.

TABLE 2

| Formulation for Cyan Liquid Developers | | | | |
|---|---|---|---|---|
| EXAMPLE | Grams Toner Concentrate from Example I | Grams Added NORPAR 15 ® | Grams Added 1% Charge Director | Charge Director Preparation Example & Level in Milligrams CD/gram Toner Solids |
| XIV A | 28.05 | 161.95 | 10.0 | Example VII at 50/1 |
| XIV B | 28.05 | 157.95 | 14.0 | Example VII at 70/1 |
| XIV C | 28.05 | 153.95 | 18.0 | Example VII at 90/1 |
| XIV D | 28.05 | 161.95 | 10.0 | Example VIII at 50/1 |
| XIV E | 28.05 | 157.95 | 14.0 | Example VIII at 70/1 |
| XIV F | 28.05 | 153.95 | 18.0 | Example VIII at 90/1 |

TABLE 3

| Cyan Liquid Developers | | | | | |
|---|---|---|---|---|---|
| Example | Equilibration Time in Days | Charge Director Level in mg/g | Mobility E-10 $m^2/Vs$ | Cond. pmho/cm | Comments |
| Control 4 | 2 | 50/1 | −1.80 | 14 | Low Charging & High Conductivity |
| Control 5 | 2 | 50/1 | −1.60 | 15 | Low Charging & High Conductivity |
| Control 6 | 2 | 70/1 | −1.37 | 21 | Low Charging & Very High Conductivity |
| Control 7 | 2 | 90/1 | −1.30 | 28 | Low Charging & Very High Conductivity |
| Example XIV A | 1 | 50/1 | −2.42 | 9 | High Charging & Low Conductivity |
| Example XIV B | 1 | 70/1 | −2.38 | 12 | High Charging & High Conductivity |
| Example XIV C | 1 | 90/1 | −2.15 | 15 | High Charging & High Conductivity |
| Example XIV D | 1 | 50/1 | −2.11 | 5 | High Charging & Low Conductivity |
| Example XIV E | 1 | 70/1 | −2.06 | 7 | High Charging & Low Conductivity |
| Example XIV F | 1 | 90/1 | −2.18 | 9 | High Charging & Low Conductivity |

Other embodiments and modifications of the present invention may occur to those skilled in the art subsequent to a review of the information presented herein; these embodiments and modifications, as well as equivalents thereof, are also included within the scope of this invention.

What is claimed is:

1. A nonpolar liquid developer comprised of a liquid, thermoplastic resin particles, a nonpolar liquid soluble charge director consisting essentially of a zwitterionic quaternary ammonium block copolymer wherein both cationic and anionic sites contained therein are covalently bonded within the same polar repeat unit in the quaternary ammonium block copolymer.

2. A negatively charged liquid developer consisting essentially of a nonpolar liquid, thermoplastic resin particles, a charge adjuvant pigment, and a nonpolar liquid soluble polymeric ionic charge director comprised of a zwitterionic AB quaternary ammonium block copolymer wherein A represents a polar block and B represents a nonpolar block, and which AB block copolymer contains cationic sites and anionic sites therein which covalently bonded to the A block.

3. A liquid electrostatographic developer consisting essentially of (A) a nonpolar liquid having a Kauributanol value of from about 5 to about 30 and present in a major amount of from about 50 percent to about 95 weight percent; (B) thermoplastic resin particles and pigment particles; (C) a nonpolar liquid soluble polymeric ionic charge director comprised of a zwitterionic quaternary ammonium block copolymer, which copolymer contains cationic and anionic sites covalently bonded within the same polar repeat unit in the quaternary ammonium block copolymer; and (D) a charge adjuvant.

4. A developer in accordance with claim 2 wherein the charge director is of the formula

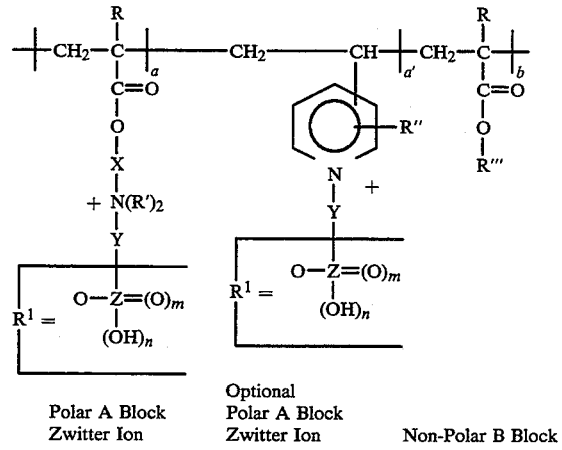

wherein R is hydrogen, alkyl, aryl, or alkylaryl; $R^1$ is a conjugate oxygen containing acid anion derived from carbon, sulfur, or phosphorus; Z is carbon, sulfur, phosphorus or a substituted phosphorous PR; m is 1 or 2 doubly bonded oxygen atoms; n is 0 or 1 hydroxyl groups; R′ is alkyl, aryl, cycloalkyl, cycloalkylenyl cycloalkylalkyl, cycloalkylaryl or alkylaryl; R″ is alkyl, aryl, cycloalkyl, cycloalkylalkyl, cycloalkylaryl or alkylaryl; R‴ is alkyl, aryl, cycloalkyl, cycloalkylalkyl, cycloalkylaryl or alkylaryl of 4 to 20 carbons; X is alkylene or arylalkylene; Y is alkylene or arylalkylene; $aM_a+a'M_{a'}$ is from about 200 to about 10,000 and $bM_b$ is from about 2,000 to about 50,000 wherein a, a′ and b is the number average degree of polymerization (DP), and $M_a$, $M_{a'}$ and $M_b$ is the corresponding repeat unit molecular weights.

5. A developer in accordance with claim 3 wherein the charge adjuvant is aluminum stearate.

6. A developer in accordance with claim 2 wherein the resin particles are comprised of a copolymer of ethylene and an $\alpha$, $\beta$ ethylenically unsaturated acid selected from the group consisting of acrylic acid and methacrylic acid, or mixtures thereof.

7. A developer in accordance with claim 2 wherein the resin particles are selected from the group consisting of a styrene polymer, an acrylate polymer, a methacrylate polymer, a polyester, and mixtures thereof.

8. A developer in accordance with claim 2 wherein the resin is selected from the group consisting of a copolymer of ethylene, and acrylic or methacrylic acid, an alkyl ester of acrylic and methacrylic acid wherein alkyl contains from 1 to about 5 carbon atoms and a copolymer of ethylene, and methacrylic acid with a melt index at 190° C. of 500.

9. A developer according to claim 1 further containing a colorant.

10. A developer according to claim 9 wherein the colorant is a pigment or a dye.

11. A developer in accordance with claim 10 wherein the pigment is cyan, magenta, yellow, red, green, blue, brown, or mixtures thereof; or carbon black.

12. A developer in accordance with claim 2 wherein the charge director is present in an amount of from about 1 percent to about 20 percent of developer solids and there is enabled a negatively charged toner.

13. A developer in accordance with claim 3 wherein component (A) is present in an amount of from 85 percent to 99.9 percent by weight based on the total weight of the developer solids of resin, pigment, and charge adjuvant which is present in an amount of from about 0.1 percent to about 15 percent by weight; and component (C) is present in an amount of from about 0.5 percent to about 100 percent of the developer solids comprised of resin, pigment, and charge adjuvant.

14. A developer in accordance with claim 3 wherein component (D) is present in an amount of 0.1 to 40 percent by weight based on the total weight of developer solids.

15. A developer in accordance with claim 2 wherein the liquid is an aliphatic hydrocarbon.

16. A developer in accordance with claim 15 wherein the aliphatic hydrocarbon is a mixture of branched hydrocarbons with from about 12 to about 16 carbon atoms.

17. A developer in accordance with claim 15 wherein the aliphatic hydrocarbon is a mixture of normal hydrocarbons with from about 12 to about 16 carbon atoms.

18. A developer in accordance with claim 2 wherein the resin is an alkylene polymer, a styrene polymer, an acrylate polymer, a polyester, or mixtures thereof.

19. An imaging method which comprises forming an electrostatic latent image followed by the development thereof with the liquid developer of claim 2.

20. An imaging method which comprises forming an electrostatic latent image followed by the development thereof with the liquid developer of claim 3.

21. A developer in accordance with claim 1 wherein the charge director is selected from the group consisting of poly(2-ethylhexyl methacrylate-co-N,N-dimethyl-N-methylenecarboxylate-N-ammoniumethyl methacrylate), poly(2-ethylhexyl methacrylate-co-N,N-dimethyl-N-propylenesulfonate-N-ammoniumethyl methacrylate), poly(2-ethylhexyl methacrylate-co-N,N-dimethyl-N-propylenephosphonate-N-ammoniumethyl methacrylate), poly(2-ethylhexyl methacrylate-co-N,N-dimethyl-N-propylenephosphinate-N-ammoniumethyl methacrylate), poly(2-ethylhexyl methacrylate-co-N,N-dimethyl-N-propylenesulfinate-N-ammoniumethyl methacrylate), poly(2-ethylhexyl methacrylate-co-N,N-diethyl-N-methylenecarboxylate-N-ammoniumethyl methacrylate), poly(2-ethylhexyl methacrylate-co-N,N-diethyl-N-propylenesulfonate-N-ammoniumethyl methacrylate), poly(2-ethylhexyl methacrylate-co-N,N-dimethyl-N-butylenephosphonate-N-ammoniumethyl methacrylate), poly( 2-ethylhexyl methacrylate-co-N,N-dimethyl-N-decamethylenephosphonate-N-ammoniumethyl methacrylate), poly(2ethylhexyl methacrylate-co-N,N-dimethyl-N-decamethylenephosphinate-N-ammoniumethyl methacrylate), poly(2-ethylhexyl methacrylate-co-N,N-dimethyl-N-butylenecarboxylate-N-ammoniumethyl methacrylate), poly(2-ethylhexyl methacrylate-co-N,N-dimethyl-N-ethyleneoxyethylenecarboxylate-N-ammoniumethyl methacrylate), poly(2-ethylhexyl methacrylate-co-N,N-dimethyl-N-ethyleneoxyethylenesulfonate-N-ammoniumethyl methacrylate), poly(2-ethylhexyl methacrylate-co-N,N-dimethyl-N-ethyleneoxyethylenephosphonate-N-ammoniumethyl methacrylate), poly(N,N-dibutylmethacrylamido-co-N,N-dimethyl-N-methylenecarboxylate-N-ammoniumethyl methacrylate), poly(N,N-dibutylmethacrylamido-co-N,N-dimethyl-N-propylenesulfonate-N-ammoniumethyl methacrylate), poly(N,N-dibutylmethacrylamido-co-N,N-dimethyl-N-propylenephosphonate-N-ammoniumethyl methacrylate), poly(N,N-dibutylmethacrylamido-co-N,N-dimethyl-N-propylenephosphinate-N-ammoniumethyl methacrylate), and poly(N,N-dibutylmethacrylamido-co-N,N-dimethyl-N-propylenesulfinate-N-ammoniumethyl methacrylate).

22. A negatively charged liquid developer in accordance with claim 2 wherein the charge director is selected from the group consisting of poly(2-ethylhexyl methacrylate-co-N,N-dimethyl-N-methylenecarboxylate-N-ammoniumethyl methacrylate), poly(2-ethylhexyl methacrylate-co-N,N-dimethyl-N-propylenesulfonate-N-ammoniumethyl methacrylate), poly(2-ethylhexyl methacrylate-co-N,N-dimethyl-N-propylenephosphonate-N-ammoniumethyl methacrylate), poly(2-ethylhexyl methacrylate-co-N,N-dimethyl-N-propylenephosphinate-N-ammoniumethyl methacrylate), poly(2-ethylhexyl methacrylate-co-N,N-dimethyl-N-propylenesulfinate-N-ammoniumethyl methacrylate), poly(2-ethylhexyl methacrylate-co-N,N-diethyl-N-methylenecarboxylate-N-ammoniumethyl methacrylate), poly(2-ethylhexyl methacrylate-co-N,N-diethyl-N-propylenesulfonate-N-ammoniumethyl methacrylate), poly(2-ethylhexyl methacrylate-co-N,N-dimethyl-N-butylenephosphonate-N-ammoniumethyl methacrylate), poly(2-ethylhexyl methacrylate-co-N,N-dimethyl-N-decamethylenephosphonate-N-ammoniumethyl methacrylate), poly(2-ethylhexyl methacrylate-co-N,N-dimethyl-N-decamethylenephosphinate-N-ammoniumethyl methacrylate), poly(2-ethylhexyl methacrylate-co-N,N-dimethyl-N-butylenecarboxylate-N-ammoniumethyl methacrylate), poly(2-ethylhexyl methacrylate-co-N,N-dimethyl-N-ethyleneoxyethylenecarboxylate-N-ammoniumethyl methacrylate), poly(2-ethylhexyl methacrylate-co-N,N-dimethyl-N-ethyleneoxyethylenesulfonate-N-ammoniumethyl methacrylate), poly(2-ethylhexyl methacrylate-co-N,N-dimethyl-N-ethyleneoxyethylenephosphonate-N-ammoniumethyl methacrylate), poly(N,N-dibutylmethacrylamido-co-N,N-dimethyl-N-methylenecarboxylate-N-ammoniumethyl methacrylate), poly(N,N-dibutylmethacrylamido-co-N,N-dimethyl-N-propylenesulfonate-N-ammoniumethyl methacrylate), poly(N,N-dibutylmethacrylamido-co-N,N-dimethyl-N-propylenephosphonate-N-ammoniumethyl methacrylate), poly(N,N-dibutylmethacrylamido-co-N,N-dimethyl-N-propylenephosphinate-N-ammoniumethyl methacrylate), and poly(N,N-dibutylmethacrylamido-co-N,N-dimethyl-N-propylenesulfinate-N-ammoniumethyl methacrylate).

23. A liquid developer in accordance with claim 1 wherein the charge director is the carboxylate zwitterionic block copolymer poly(2-ethylhexyl methacrylate-co-N,N-dimethyl-N-methylenecarboxylate-N-ammoniumethyl methacrylate).

24. A liquid developer in accordance with claim 2 wherein the charge director is selected from the group consisting of poly(2-ethylhexyl methacrylate-co-N,N-dimethyl-N-propylenesulfonate-N-ammoniumethyl methacrylate), poly(2-ethylhexyl methacrylate-co-N,N,N-trimethyl-N-ethyl methacrylate ammonium bromide), and poly(2-ethylhexyl methacrylate-co-N,N-dimethyl-N-ethyl methacrylate ammonium bromide).

25. A liquid developer in accordance with claim 3 wherein the charge director is selected from the group consisting of poly(2-ethylhexyl methacrylate-co-N,N-dimethyl-N-propylenesulfonate-N-ammoniumethyl methacrylate), poly(2-ethylhexyl methacrylate-co-N,N,N-trimethyl-N-ethyl methacrylate ammonium bromide), and poly(2-ethylhexyl methacrylate-co-N,N-dimethyl-N-ethyl methacrylate ammonium bromide).

* * * * *